US009035981B2

(12) United States Patent
Dal Col et al.

(10) Patent No.: US 9,035,981 B2
(45) Date of Patent: May 19, 2015

(54) DEVICE TO REPRODUCE IMAGES OR GRAPHICAL PATTERNS IN GENERAL ON SURFACES, AND CORRESPONDING METHOD

(76) Inventors: Alessandro Dal Col, Trieste (IT); Carlo Tavian, Vittorio Veneto (IT); Giacomo Battiston, Vittorio Veneto (IT)

( * ) Notice: Subject to any disclaimer, the term of this patent is extended or adjusted under 35 U.S.C. 154(b) by 0 days.

(21) Appl. No.: 14/116,616

(22) PCT Filed: May 11, 2012

(86) PCT No.: PCT/IB2012/000929

§ 371 (c)(1),
(2), (4) Date: Nov. 8, 2013

(87) PCT Pub. No.: WO2012/156797

PCT Pub. Date: Nov. 22, 2012

(65) Prior Publication Data

US 2014/0071217 A1 Mar. 13, 2014

(30) Foreign Application Priority Data

May 13, 2011 (IT) ..... UD2011A0072

(51) Int. Cl.

| | |
|---|---|
| ***B41F 17/00*** | (2006.01) |
| ***B41J 3/28*** | (2006.01) |
| ***B41J 3/407*** | (2006.01) |
| ***B41J 11/00*** | (2006.01) |

(52) U.S. Cl.

CPC . *B41F 17/00* (2013.01); *B41J 3/28* (2013.01); *B41J 3/407* (2013.01); *B41J 11/001* (2013.01)

(58) Field of Classification Search

None

See application file for complete search history.

(56) References Cited

U.S. PATENT DOCUMENTS

| | | | | |
|---|---|---|---|---|
| 4,897,943 | A | 2/1990 | Otake | |
| 4,920,422 | A | 4/1990 | Lapierre | |
| 5,984,470 | A * | 11/1999 | Sakino et al. | 347/106 |
| 7,350,890 | B2 * | 4/2008 | Baird et al. | 347/8 |
| 2005/0073538 | A1 | 4/2005 | Hung | |
| 2007/0062383 | A1 | 3/2007 | Gaseau et al. | |

FOREIGN PATENT DOCUMENTS

EP 0 317 219 A2 5/1989

OTHER PUBLICATIONS

International Search Report dated Aug. 24, 2012 issued in corresponding International patent application No. PCT/IB2012/000929. International Preliminary Report on Patentability and the Written Opinion of the International Searching Authority with a date of issuance of Nov. 19, 2013 issued in corresponding PCT International Application No. PCT/IB2012/000929 (6 pages).

* cited by examiner

*Primary Examiner* — Manish S Shah
*Assistant Examiner* — Jeremy Delozier
(74) *Attorney, Agent, or Firm* — Ostrolenk Faber LLP

(57) ABSTRACT

Device to reproduce images or graphical patterns in general on large surfaces, comprising at least a printing system (14) mobile in at least one direction with respect to a support frame (12)>> an optical viewing system (100) associated with the support frame (12) and able to recognize the position of the portion of image already executed, and to recognize possible reference signs affixed in the step when said portion of image was executed, in order to allow the correct positioning of the device so as to execute the adjacent portion of image that has to be executed next.

7 Claims, 3 Drawing Sheets

DEVICE TO REPRODUCE IMAGES OR GRAPHICAL PATTERNS IN GENERAL ON SURFACES, AND CORRESPONDING METHOD

CROSS REFERENCE TO RELATED APPLICATIONS

The present application is a 35 U.S.C. §371 National Phase conversion of PCT/IB2012/000929, filed May 11, 2012, which claims benefit of Italian Application No. UD2011A000072, filed May 13, 2011, the disclosure of which is incorporated herein by reference. The PCT International Application was published in the English language.

FIELD OF THE INVENTION

The present invention concerns a device and the corresponding method to reproduce images or graphical patterns in general, on large surfaces such as, but not only, walls, canvases or other surfaces, irrespective of their orientation.

The invention is applied particularly, although not exclusively, in the decoration of rooms, the facades of buildings, vehicles, and floors, in order to make indications, in restoration works etc., substantially on surfaces of any material, such as plastered walls, brickwork, plastic, glass, ceramics and tiles, metal, wood, etc.

BACKGROUND OF THE INVENTION

The complexities of reproducing graphical patterns are generally known, such as images, writings, copies of photographs, paintings, landscapes, decorations etc., in order to embellish and personalize a surface, for example an external or internal wall of a building, a fabric, a canvas, etc.

Manual solutions are closely connected to individual abilities and are lacking in repeatability and constant results.

In the state of the art partly automated solutions have been proposed, which use printing systems moved by a movement apparatus commanded by a computerized control unit.

For example apparatuses are known consisting of Cartesian type structures, for example a frame with movement on the x axis and y axis, which move a printing system, for example the paint gun type, with an ink jet head, a laser head or other, along the surface to be painted.

One disadvantage of known solutions derives from the fact that the bearing structure of the apparatus is not moved during the printing step of all the programmed and desired image.

Therefore, these solutions are satisfactory when the image to be reproduced is the same size as or smaller than the machine used, but they are not so if the size of the image is larger than the machine; alternatively, the apparatuses are complex and bulky if they have sizes comparable to those of the image.

One purpose of the present invention is to supply a device and a method to reproduce images, writings, decorations or graphical patterns in general on very large surfaces, using apparatuses of limited sizes, thus simplifying transport and use in restricted spaces, or which are difficult to reach.

Another purpose is to guarantee that the images reproduced are high quality, repeatable, with continuity in the lines and graphical patterns, with imperceptible joints between the various portions, in short times and at reasonable costs, and that this can be done easily and practically even by people who are not particularly expert.

The Applicants have devised, tested and embodied the present invention to overcome the shortcomings of the state of the art and to obtain these and other purposes and advantages.

SUMMARY OF THE INVENTION

In accordance with the above purposes, the invention provides a method in which the area to be decorated, painted or otherwise embellished or enhanced, is divided into a plurality of consecutive sub-areas, to each of which is assigned a precise portion of the image or graphical pattern to be reproduced.

The invention also provides that, after the reproduction of the image has been completed in a first of the areas, the printing instrument is repositioned on each occasion in an adjacent position, without needing to carry out measurements or observations by the operator and without needing any positioning by the operator, and in any case the absolute continuity and precision between the adjacent portions of image reproduced one after the other is guaranteed.

According to one form of embodiment of the present invention, the device used in the above method comprises a printing system, for example a print head, a paint gun system or other system, which may be one known in the state of the art, mounted on a support frame which allows it to be moved on a plane.

The support frame has variable dimensions according to need but, in the spirit of the invention, it is not bulky but easy to transport, assemble and store. In one solution of the invention, the support frame is square or rectangular with sides between 30 and 100 centimeters.

In a first solution, the device is suitable to be used manually, kept by the operator in a position facing the surface to be decorated at a suitable distance so that the printing system can make the decoration.

According to a variant, the device can be associated with a support system, for example a tripod, a base, a pole or suchlike, also of the self-moving type.

According to the invention, the support frame allows movement of the printing system along at least two axes, for example axes x and y of a Cartesian plane.

In order to carry out this movement, there are at least two systems with a motorized drive, one for each axis of movement, by means of which the printing system is correctly positioned to perform the programmed printing.

The device according to the invention is also equipped with an optical viewing system, for example with one or more cameras, or LED or laser devices associated with corresponding electro-optical transducers.

The optical system for example allows recognition of the position of the portion of the image already done, and recognition of possible reference signs affixed on the wall, canvas or other surface to be decorated in the execution of said portion of the image, in order to allow the correct positioning of the device so as to execute the adjacent portion of the image which is to be done next.

The subsequent positioning of the whole device can be carried out manually by the operator, to the position where the optical system indicates that the reference signs have been recognized and signals to the operator for example to rest the device on the wall in order to execute the next portion of image; in variant embodiments, the positioning of the device is governed by a system for moving the possible support on which the device is mounted.

In one form of embodiment of the invention, the device also comprises a device for detecting the inclination, associated for example with the support frame, which detects if the frame is correctly positioned with respect to the wall to be decorated, before starting printing and/or during printing, and possibly corrects the position and drive of the printing system to guarantee that the portion of image is correctly oriented even in the presence of a support frame that is not correctly positioned.

According to the present invention, the device is associated with a command and control unit which regulates and manages the functioning thereof. The command and control unit comprises at least a memory containing an archive of a plurality of images, decorations, designs, landscapes and graphical patterns in general, which a user can access in order to select the graphical pattern to be reproduced.

The command and control unit may comprise, or be associated with, a unit for acquiring images, for example a scanner, a camera or other suitable device, to acquire an image which then, suitably sized, for example enlarged, can be reproduced on the surface to be decorated.

The command and control unit may also comprise a command interface with which an operator can not only select from the archive the image to be reproduced, but can also modify it, for example inserting writings or suchlike, or he can combine together two or more images, or process a selected image as desired.

The command and control unit is also connected to the support frame of the printing system to determine the movement thereof on the Cartesian axes according to the image to be printed.

BRIEF DESCRIPTION OF THE DRAWINGS

These and other characteristics of the present invention will become apparent from the following description of a preferential form of embodiment, given as a non-restrictive example with reference to the attached drawings wherein.

DESCRIPTION OF PREFERRED EMBODIMENTS

Figure 1:
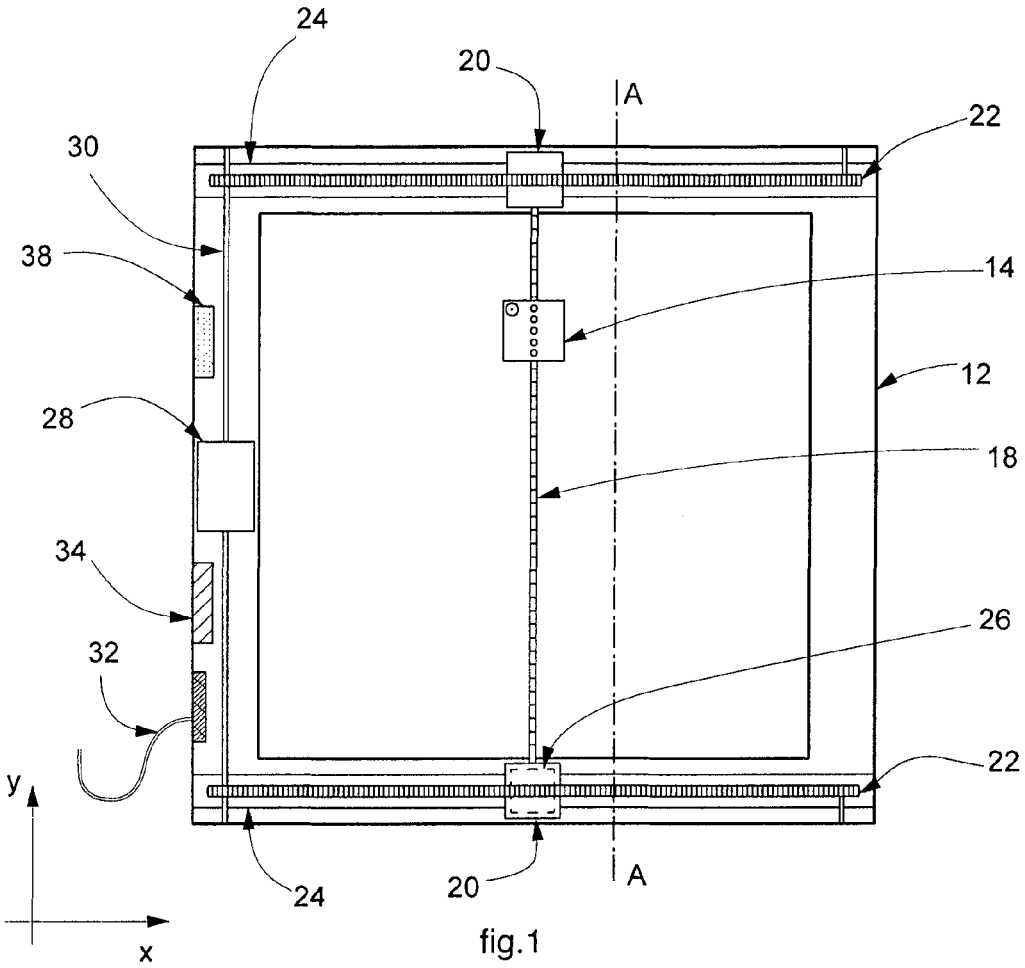
FIG. 1 shows a rear view of the device according to the present invention according to one form of embodiment.
Figure 2:
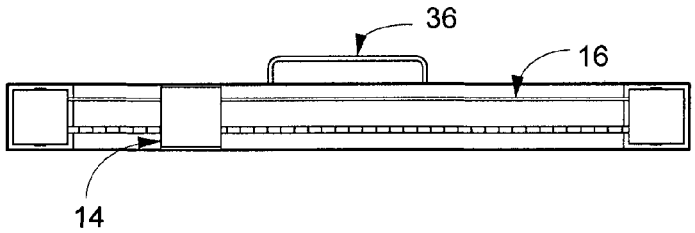
FIG. 2 shows a section of the device in FIG. 1 from A to A.

A device to reproduce images 10, as shown in FIGS. 1 and 2, comprises a bearing frame 12, in this case square, with sides equal to about 50 cm. In one solution that is not shown here, the bearing frame 12 may have feet or little suckers, or a similar feature to facilitate its resting on the wall to be decorated by the operator, and also to increase its stability during use.

It is obvious that both the shape and sizes of the device 10 shown in the drawings are merely indicative; the sizes may change, although the device remains configured for a mainly manual use, so that its sizes and weight allow it to be kept in position by an operator, also during use.

The device 10 shown in the drawings in this case comprises a print head 14 that can move in the bearing frame, in a vertical direction "y", along a first guide 16.

Here and hereafter in the description the directions vertical and horizontal refer to the representation in FIG. 1, although it is obvious that the device 10 can be used with any orientation, also with the sides inclined with respect to a horizontal or vertical direction.

The print head 14 is passed through by a worm screw 18 which, at both ends, is connected to a corresponding support 20; the supports 20 support the print head 14 and allow it to rotate. The supports 20 are both connected to a belt 22 (as shown in FIG. 1) which allows them to move along a second guide 24 in a horizontal direction "x".

The movement in the vertical direction of the print head 14 is generated by the fact that the worm screw 18 can rotate in one direction or the other, the rotational movement being determined by a first drive means 26 that is disposed inside one of the two supports 20, in this case the lower one.

To make the two belts 22 rotate, one of which is located in a first horizontal side and the other in the opposite horizontal side of the frame 12, in order to impart the horizontal movements to the support frame 12, a second drive means 28 is used, connected to a support 30 that transmits the rotation of the second drive means 28 to the two belts 22.

The functioning of the first drive means 26 and the second drive means 28 is managed by a control unit 40 (shown in FIG. 4*a*), which is connected to the device 10 by means of a cable 32. It comes within the field of the invention that the device 10 may be connected to the control unit by means of a wireless connection, Bluetooth or any other type of wireless connection.

To determine the inclination of the device 10 for a possible correction of the orientation of the image to be painted by the control unit, on one side of the frame 12 there is a three-axis accelerometer 34.

Obviously, it comes within the field of the invention that one or more accelerometers 34 may be disposed on one or more corresponding sides of the support frame 12.

Figure 3:
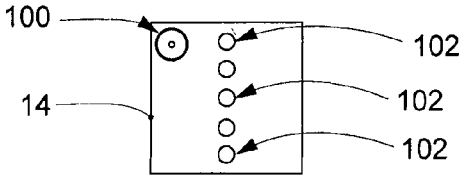
FIG. 3 shows the detail of the printing system of the device in FIG. 1.

The print head 14, as shown in FIG. 3, consists of nozzles 102 (for example five: cyan, magenta, yellow, white and black) with corresponding cartridges to paint the wall 200 with the portion of image, and of an optical detection system 100, which is used in the movements of the device 10 to determine, by the control unit 40, at least the position of one or more portions already produced, and thus to determine the point from where the painting of the wall 200 is to be restarted.

In one form of embodiment shown in FIG. 2, the device 10 has two handles 36 associated with the frame 12 of the device 10, to allow manual use by an operator.

The device 10 can also be bigger, and therefore not able to be easily held manually by the operator, or at least for the period required to complete a respective portion of image; in this case, one form of embodiment of the invention provides that the support frame 12 is mounted on a self-moving support 208 (shown by dashes in FIG. 4*a*) and the painting operations in this case can be carried out at least partly without the operator.

The device 10 as described heretofore functions as follows.

Figure 4B:
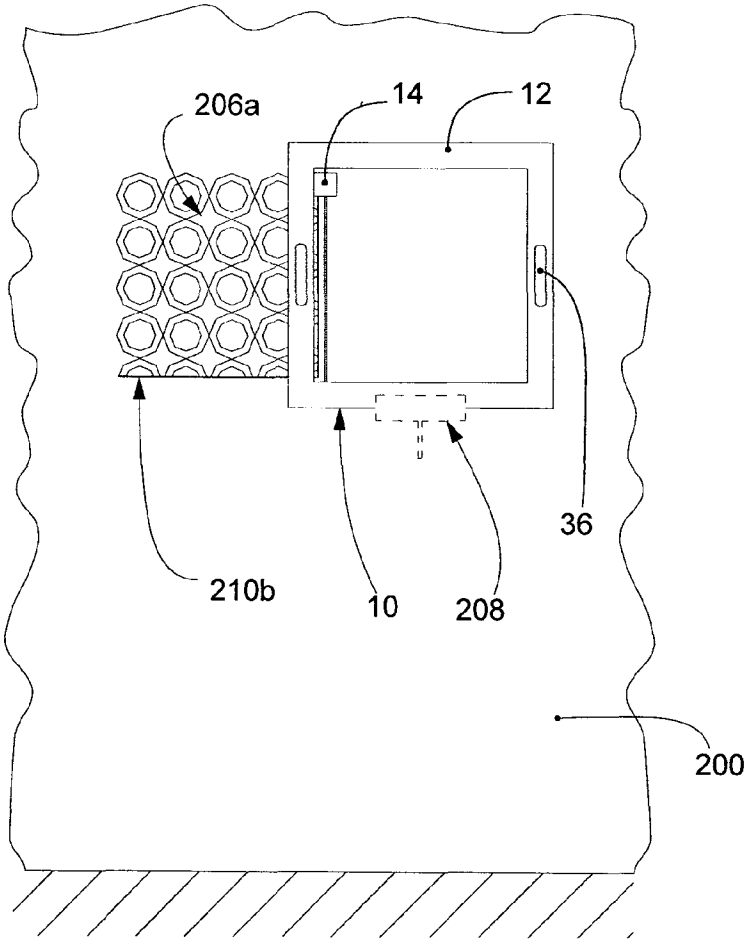
FIGS. 4*a*, 4*b*, 4*c* and 4*d* show a sequence of the decoration steps of a wall using the present invention.
Figure 4A:
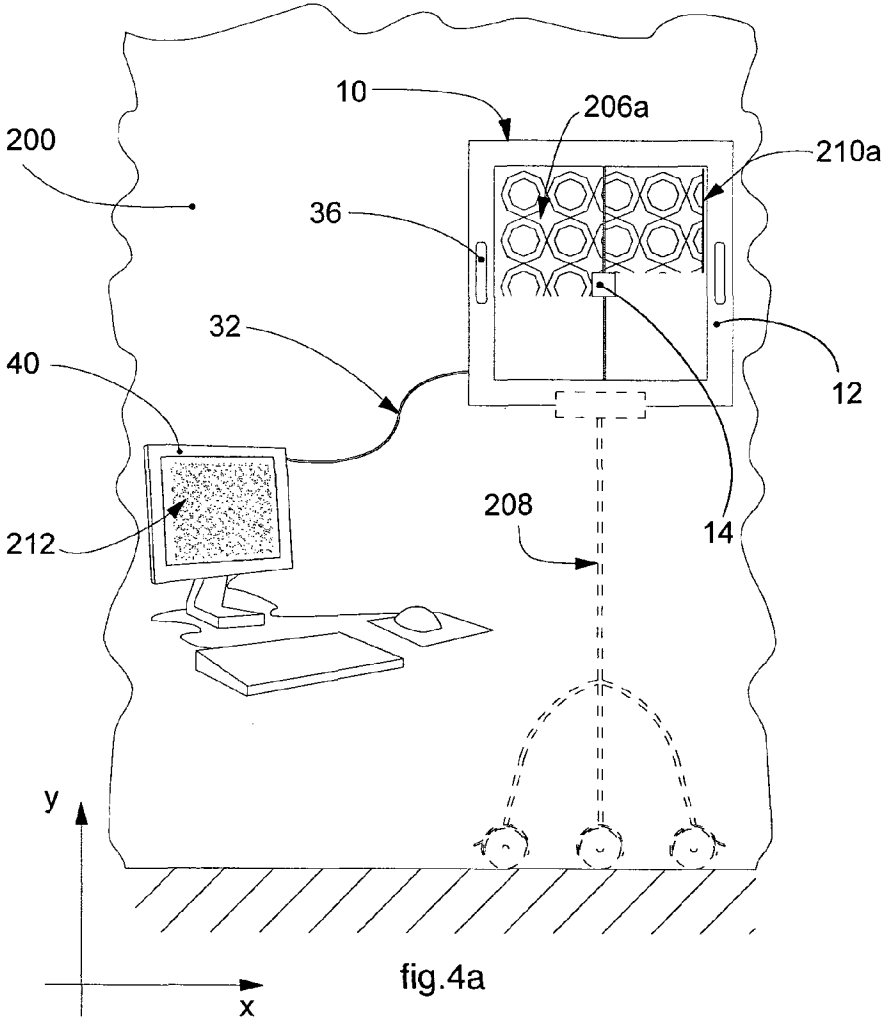
Figure 4D:
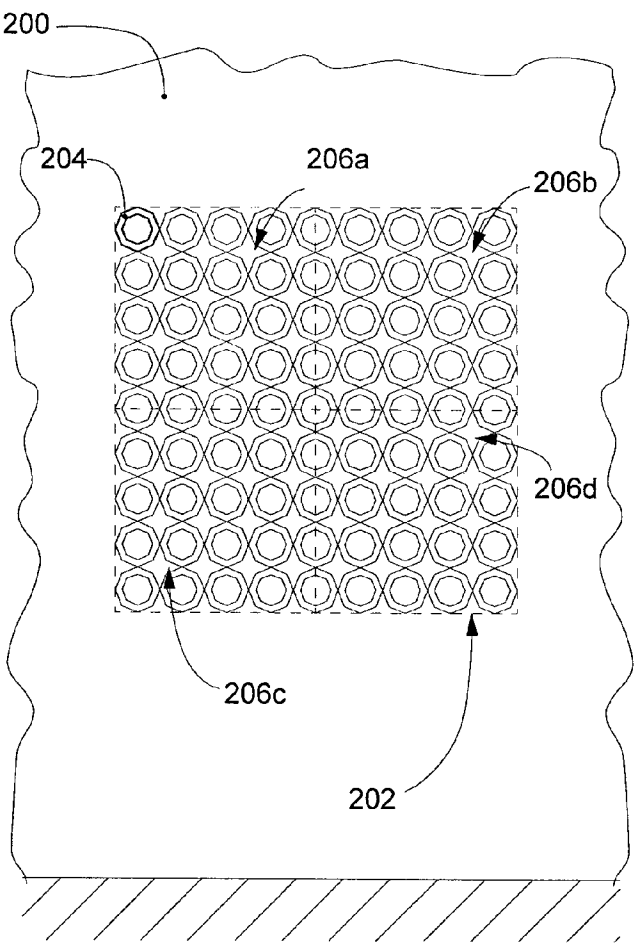

FIG. 4*d* shows a wall completely painted with an image 202 that is to be obtained by repeating a decorative element 204 both vertically "y" and horizontally "x".

FIG. 4*a* shows the first step of the method to paint the wall 200 using the device 10 where the image 202 to be reproduced is divided into different sequential portions, respectively 206*a*, 206*b*, 206*c*, 206*d*. The device 10 is positioned, either manually by the operator using the two handles 36, or using a self-moving device 208 which supports the device 10, in correspondence with the upper left edge from where the reproduction of the first portion of image 206*a* on the wall 200 is to start.

The device 10 starts painting the first portion of image moving the print head 14 in both a horizontal direction "x" and in a vertical direction "y" along the whole length of the device 10.

In correspondence with the horizontal end of the first portion of image 206*a* with which subsequently a second portion of image 206*b* will be placed laterally adjacent, the device 10 will trace a vertical edge 210*a* which will subsequently be used to recognize the portion of image already painted. In correspondence with the vertical end of the first portion of image 206*a* with which subsequently another portion of image 206*c* will be placed vertically adjacent, the device 10 will trace a horizontal edge 210*b* (as shown in FIG. 4*b*) which will subsequently be used to recognize the portion of image already painted.

In FIG. 4*b* the device 10 has finished painting the first portion of image 206*a*, in which the corresponding edges 210*a*, 210*b* are shown, continuous with the subsequent portions of image which have to be made subsequently. The device 10 can therefore be moved toward the subsequent portion of the image. As shown in FIG. 4*b*, the device 10 is moved laterally so that it can reproduce the portion of image 206*b* which is on the right of the portion of image 206*a* already done. To determine the position from where painting is restarted, the device 10 uses the detection system 100 mounted inside the print head 14, to analyze the position of the vertical edge 210*a* which has already been done.

Figure 4C:
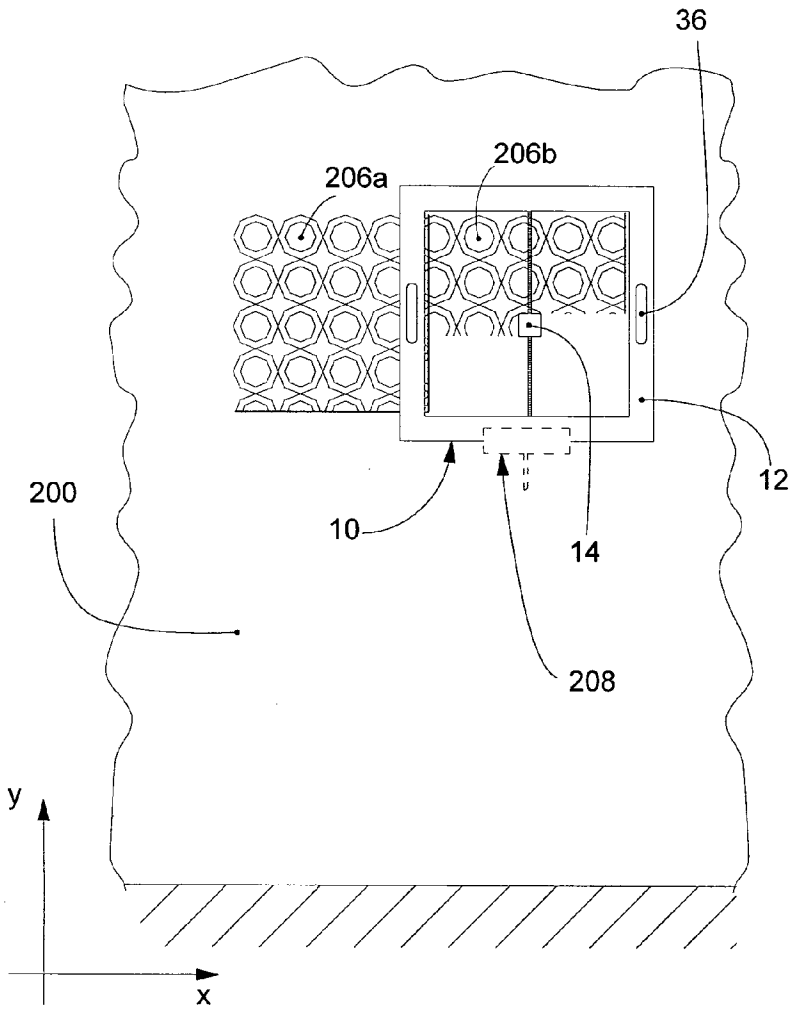

As shown in FIG. 4*c*, once the position of the edge 210*a* has been determined, the device 10 starts painting the second portion of image 206*b* with the same characteristics and method as described before. The edge 210*a*, having been painted with a shade of color compatible with the portion of image 206*b*, will be totally covered by the painting of the portion of image 206*b*, in this way giving the idea of continuity of the image 202.

It is clear that modifications and/or additions of parts may be made to the device to reproduce images 10 as described heretofore, without departing from the field and scope of the present invention.

For example, it comes within the field of the invention that, instead of the printing system with nozzles as described heretofore, laser engraving heads may be used, milling, or even dispensers of gluing substances, for example to apply materials such as wall paper or decorations in general according to particular graphical patterns.

It is clear that instead of tracing a specific edge, such as 210*a* as previously described, any reference sign whatsoever, or part of an image, can be used as a reference.

It is also clear that, although the present invention has been described with reference to some specific examples, a person of skill in the art shall certainly be able to achieve many other equivalent forms of device to reproduce images 10, having the characteristics as set forth in the claims and hence all coming within the field of protection defined thereby.

What is claimed is:

1. Device to reproduce images or graphical patterns in general on large surfaces, comprising:

a support frame provided with at least a first guide along a first direction and at least a second guide along a second direction;

at least one printing system movable with respect to said support frame;

at least one first motor means designed to move said at least one printing system along said first direction and at least one second motor means designed to move said printing system along said second direction;

an optical viewing system associated with said support frame and able to recognize the position of the portion of image already executed, and to recognize possible reference signs affixed in the step when said portion of image was executed, in order to allow the correct positioning of the device so as to execute the adjacent portion of image that has to be executed next;

a control unit able to divide into a plurality of sub-portions an image or graphical pattern to be reproduced, to command said printing system to execute, in a first reproduction step, a first of said sub-portions and one of said reference signs so as to allow the positioning of said support frame using said one of said reference signs for the execution of a second of said sub-portions; and at least one accelerometer to detect the inclination of the device, the at least one accelerometer being disposed on at least one side of the support frame, so as to detect the orientation of the support frame with respect to the wall to be decorated, and to determine the correct orientation of the decoration to be executed in order to compensate for any possible erroneous orientation of the printing system before and during movement of the at least one printing system.

2. Device as in claim 1, wherein said support frame has handles so that it can be driven and supported manually, and/or supporting feet to cause the support frame to rest on the surface to be decorated.

3. Device as in claim 1, wherein the device has a square or rectangular shape with the size of a side of the square or rectangular shape being between 30 and 100 cm.

4. Device as in claim 1, wherein the device is associated or associable with a self-moving support device.

5. Method to reproduce an image on a wall or other surface using the device as in claim 1, comprising the following steps:

a) selecting an image from an electronic type memory;

b) dividing the image into a plurality of sub-portions;

c) executing, on said wall or other surface, a first sub-portion of said plurality of sub-portions;

d) moving the device to a position adjacent to said first sub-portion in order to execute an adjacent second sub-portion of said plurality of sub-portions;

e) recognizing a part of the image already reproduced present in the first sub-portion for the aligned execution of the second sub-portion and execution of the same; and f) repeating steps c)-e) until all of the image is reproduced.

6. Method as in claim 5, wherein reference signs are used, specifically affixed to facilitate the recognition of the edges of the portion of the image already reproduced on the wall.

7. Method as in claim 5, comprising at least a step of dynamically detecting the inclination of the device with respect to the wall, with possible correction of the image to be reproduced according to the inclination detected of the device.

* * * * *